US006499734B1

(12) United States Patent
Tranquilla

(10) Patent No.: US 6,499,734 B1
(45) Date of Patent: Dec. 31, 2002

(54) SYSTEM AND METHOD FOR DETECTING A DOCUMENT TRAILING EDGE EXITING FEEDER

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/004,128

(22) Filed: Dec. 4, 2001

(51) Int. Cl.[7] ..... B65H 5/00
(52) U.S. Cl. ..... 271/10.03; 271/110; 271/272
(58) Field of Search ..... 271/3.15, 3.17, 271/10.03, 110, 111, 270, 272, 274

(56) References Cited

U.S. PATENT DOCUMENTS

| | | | | |
|---|---|---|---|---|
| 4,451,027 A | * | 5/1984 | Alper | 271/10.02 |
| 4,540,170 A | * | 9/1985 | Masuda et al. | 271/259 |
| 5,462,267 A | * | 10/1995 | Hori | 271/10.04 |
| 5,594,486 A | * | 1/1997 | Kiyohara | 347/104 |
| 5,848,784 A | | 12/1998 | Tranquilla | |
| 5,969,274 A | * | 10/1999 | Johnson | 271/3.17 |
| 6,089,561 A | * | 7/2000 | Marshall et al. | 271/10.03 |
| 6,102,388 A | * | 8/2000 | Thornhill | 271/119 |
| 6,170,820 B1 | * | 1/2001 | Hutson | 271/274 |
| 6,199,854 B1 | | 3/2001 | Tranquilla et al. | |
| 6,282,403 B1 | * | 8/2001 | Spencer et al. | 271/272 |

FOREIGN PATENT DOCUMENTS

JP 57160846 A * 10/1982 ..... B65H/7/12

* cited by examiner

*Primary Examiner*—H. Grant Skaggs
*Assistant Examiner*—Matthew J. Kohner
(74) *Attorney, Agent, or Firm*—Brooks & Kushman PC; Lise A. Rode; Mark T. Starr

(57) ABSTRACT

A method of detecting a document in a system for feeding and transporting documents includes detecting an acceleration of an accelerator idler indicating when the document trailing edge exits a feeder and a separator. The system includes a feeder stage including the feeder and the separator for receiving a document therebetween and gripping the document with a first grip, and a transport stage downstream of the feeder stage. The transport stage includes an accelerator driver and the accelerator idler for receiving the document therebetween and gripping the document with a second grip that is less than the first grip. When the document is simultaneously gripped by the feeder and separator and gripped by the accelerator driver and accelerator idler, the document slips at the accelerator driver until the document trailing edge exits the feeder and separator. The acceleration of the accelerator idler is detected to indicate when the document trailing edge exits the feeder and separator.

14 Claims, 1 Drawing Sheet

SYSTEM AND METHOD FOR DETECTING A DOCUMENT TRAILING EDGE EXITING FEEDER

CROSS-REFERENCE TO RELATED APPLICATIONS

The subject matter disclosed herein is related to the subject matter disclosed in U.S. patent Ser. No. 10/004,127 entitled "Method and System for Tracking Document Trailing Edge Position," by Michael N. Tranquilla, filed Dec. 4, 2001, which is assigned to the assignee of the instant application, and the contents of which are incorporated by reference herein.

BACKGROUND OF THE INVENTION

1. Field of the Invention

The present invention relates to systems for feeding and transporting documents and to a system and method for detecting a document trailing edge exiting a feeder.

2. Background Art

A typical system for feeding and transporting documents includes a feeder and a separator in the document feeding portion of the system, and a series of roller pairs or belts in the document transporting portion of the system. In the feeding portion of the system, the feeder acts with the separator to feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. The separator may be a wheel, but also may take other forms such as a belt. Further, the components in the transporting portion of the system may take a variety of forms. Systems also include a component in the document feeding portion of the system that nudges documents into the nip between the feeder and the separator. A suitable nudger may be a nudger wheel, but may take other forms. An existing document feeder is shown in U.S. Pat. No. 6,199,854. That patent describes a document feeder with a variable speed separator.

In existing systems for transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. Although some existing systems may successfully perform operations that depend on the position of the document, these existing systems do have their limitations. In certain situations, it would be desirable to know immediately when a first document trailing edge has left the feeder so that operations can be performed on a second, following, document with the feeder as soon as possible without affecting the first document. Further, it would be desirable to know such information so that operations can be performed on the first, leading, document in the transport stage without the first document being affected by actions of the feeder. Existing systems have a shortcoming in that there is no way to know immediately when a document trailing edge has left the feeder.

For the foregoing reasons, there is a need for a system and method for detecting a document trailing edge exiting a feeder.

SUMMARY OF THE INVENTION

It is, therefore, an object of the present invention to provide a system and method for detecting a document trailing edge exiting a feeder.

In carrying out the above object, a system for feeding and transporting documents is provided. Each document has a leading edge and a trailing edge. The system comprises a feeder stage, a transport stage, a tachometer, and control logic. The feeder stage includes a feeder and a separator for receiving a document therebetween and gripping the document with a first grip. The transport stage is downstream of the feeder stage. The transport stage includes an accelerator driver and an accelerator idler for receiving the document therebetween and gripping the document with a second grip that is less than the first grip. When the document is simultaneously gripped by the feeder and separator and gripped by the accelerator driver and accelerator idler, the document slips at the accelerator driver until the document trailing edge exits the feeder and separator. The tachometer is at the accelerator idler. The control logic is configured to detect an acceleration of the tachometer indicating when the document trailing edge exits the feeder and separator, and to provide an output signal.

In a preferred embodiment, the system further comprises a control device receiving the output signal. The control device is configured to perform an operation after the document trailing edge has exited the feeder and separator.

In embodiments of the present invention, the tachometer may include an encoder and generate a pulse sequence. The control logic would then detect the acceleration based on the pulse sequence. Or, the tachometer may generate an analog velocity signal, and the control logic would then detect the acceleration based on the analog velocity signal.

In a preferred embodiment, the system further comprises a feeder tachometer at the feeder. The control logic is configured to detect a relative acceleration of the accelerator idler tachometer with respect to the feeder tachometer indicating when the document trailing edge exits the feeder and separator.

Further, in carrying out the present invention, a method of detecting a document in a system for feeding and transporting documents is provided. The document has a leading edge and trailing edge. The system includes a feeder stage, including a feeder and a separator for receiving a document therebetween and gripping the document with a first grip. The system further includes a transport stage downstream of the feeder stage. The transport stage includes an accelerator driver and an accelerator idler for receiving the document therebetween and gripping the document with a second grip that is less than the first grip. When the document is simultaneously gripped by the feeder and separator and gripped by the accelerator driver and accelerator idler, the document slips at the accelerator driver until the document trailing edge exits the feeder and separator. The method comprises detecting an acceleration of the accelerator idler indicating when the document trailing edge exits the feeder and separator.

In a preferred embodiment, the method further comprises, after detecting the acceleration of the accelerator idler, performing an operation after the document trailing edge has exited the feeder and separator. Preferably, the method further comprises providing a tachometer at the accelerator idler.

In embodiments of the present invention, the tachometer may include an encoder and generate a pulse sequence. Or, the tachometer may generate an analog velocity signal.

In a preferred embodiment, the method further comprises detecting a relative acceleration of the accelerator idler with respect to the feeder indicating when a document trailing edge exits the feeder and separator. More preferably, the method further comprises providing a tachometer at the accelerator idler, and providing a feeder tachometer at the feeder.

The advantages associated with embodiments of the present invention are numerous. For example, embodiments of the present invention provide systems and methods for detecting a document trailing edge exiting a feeder. Detecting the document trailing edge exiting the feeder allows operations to be performed on a second, following, document with the feeder as soon as possible without affecting the first document. Further, detecting the document trailing edge exiting the feeder allows operations to be performed on the first, leading, document in the transport stage without the first document being affected by actions of the feeder. Systems of the present invention utilize a tachometer at the accelerator idler, while methods of the present invention comprise detecting acceleration of the accelerator idler. Many document processing products could benefit from embodiments of the present invention. For example, copiers, fax machines, sheet feeders for computer printers, automatic teller machines, and document image scanners are just a few examples of products that could benefit from embodiments of the present invention.

The above object and other objects, features, and advantages of the present invention are readily apparent from the following detailed description of the preferred embodiment when taken in connection with the accompanying drawings.

DETAILED DESCRIPTION OF THE PREFERRED EMBODIMENT

Figure 1:
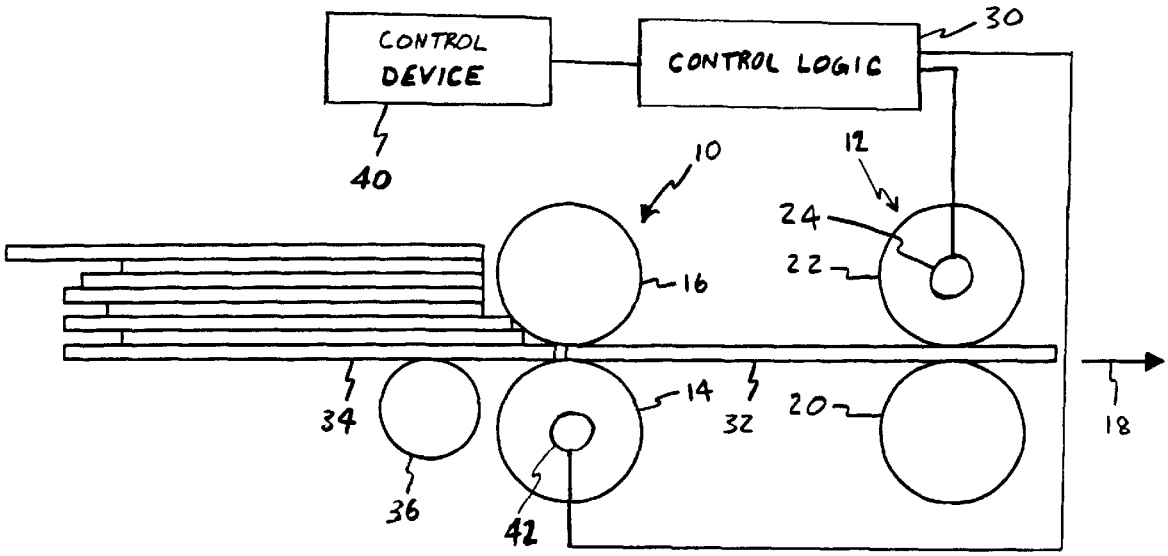
FIG. 1 illustrates a system for feeding and transporting documents according to a preferred embodiment of the present invention.

FIG. 1 illustrates a system for feeding and transporting documents. The system includes a feeder stage 10 and a transport stage 12. Feeder stage 10 includes a feeder 14 and a separator 16. Transport stage 12 is downstream of feeder stage 10, with arrow 18 pointing in the downstream direction. A document leading edge is the more downstream edge while the trailing edge is the more upstream edge. Feeder 14 and separator 16 of feeder stage 10 receive a document therebetween and grip the document with a first grip. Transport stage 12 is downstream of feeder stage 10 and includes an accelerator driver 20 and an accelerator idler 22 for receiving a document therebetween and gripping the document with a second grip that is less than the first grip. The document stack is shown adjacent separator 16 and includes first, leading, document 32 and second, following, document 34 among other documents in the stack, with the trailing edge of first document 32 being about to exit feeder 14 and separator 16. The second grip of accelerator driver 20 and accelerator idler 22 is less than the first grip of feeder 14 and separator 16 such that when a document is simultaneously gripped by feeder 14 and separator 16 and gripped by accelerator driver 20 and accelerator idler 22, the document slips at accelerator driver 20 until the document trailing edge exits feeder 14 and separator 16. A tachometer 24 is shown at accelerator idler 22. Control logic 30 is configured to detect an acceleration of tachometer 24 indicating when the document trailing edge exits feeder 14 and separator 16. Control logic 30 provides an output signal to control device 40. Control device 40, included in a preferred embodiment, receives the output signal from control logic 30 and is configured to perform an operation after the document trailing edge has exited the feeder and separator.

The components shown in FIG. 1 are preferred, and alternative arrangements are possible. For example, the feeder is shown as a feed wheel 14, but may take other forms. The separator is shown as a separator wheel 16, but also may take other forms such as a belt. As shown, feed wheel 14 rotates clockwise, driven by its own motor, and separator or retarder wheel 16 is fixed or runs slowly. Further, the components in transporting portion 12 may take a variety of forms and are shown as an accelerator driver wheel 20 and an accelerator idler wheel 22. In a preferred embodiment, the system includes a suitable nudging device such as nudger wheel 36. Further, tachometer 24 may be implemented in any suitable way. For example, tachometer 24 may include an encoder and generate a pulse sequence, with control logic 30 detecting the acceleration of accelerator idler 22 based on the pulse sequence. Or, tachometer 24 may generate an analog velocity signal, with control logic 30 detecting the acceleration of accelerator idler 22 based on the analog velocity signal. In addition, a preferred embodiment includes feeder tachometer 42 at feeder 14. Control logic 30 may then detect the relative acceleration of accelerator idler tachometer 24 with respect to feeder tachometer 42 indicating when the document trailing edge exits feeder 14 and separator 16. It is appreciated that the varying relationships between rotational and surface speeds for different components are taken into account when control logic 30 makes any determinations.

With continuing reference to FIG. 1 in which a preferred embodiment of a system for feeding and transporting documents is illustrated, feed wheel 14, separator 16, and nudger 36 are typical elements for feeding documents singly from a document stack. Downstream accelerator wheel pair 20 and 22 accept the document from feed wheel 14 and separator 16. The accelerator drive wheel 20 may or may not be driven by the same motor that drives feed wheel 14. The accelerator drive wheel 20 is running at higher peripheral speed than feed wheel 14 to create space between documents. Feed wheel 14 and separator wheel 16 have a greater grip on the document than the accelerator drive wheel 20 and accelerator idler wheel 22. In a preferred system, accelerator idler wheel 22 has attached to it a tachometer 24 to indicate accelerator idler velocity. The tachometer may take any suitable form and use any suitable technique to determine a signal that indicates an acceleration. For example, tachometer 24 may include an encoder and generate a pulse sequence, or may generate an analog velocity signal. The accelerator idler wheel 22 and accelerator driver wheel 20 grip the document, that is, apply a pinch force. Feeder 14 and separator 16 also grip the document by applying a pinch force and have a greater grip on the document than the accelerator wheel pair 20 and 22.

As shown, feeder 14 and separator 16 have a greater grip on first document 32 than accelerator driver 20 and accelerator idler 22. As such, the velocity of first document 32 is the peripheral velocity of feed wheel 14. At the shown instance, accelerator driver 20 is slipping relative to document 32. Accelerator idler 22 is driven by document 32, so the peripheral velocity of accelerator idler 22 is the same as feed wheel 14. For good document control, the distance between feed wheel 14 and accelerator wheel pair 20 and 22 is generally less than the minimum length document. Therefore accelerator idler 22 is able to decelerate from accelerator driver wheel speed to feed wheel speed in a short distance after the leading edge of a document has entered the nip between accelerator driver 20 and accelerator idler 22. The deceleration is generally complete before the document trailing edge reaches the feed wheel 14/separator 16 nip. The trailing edge of document 32 is shown at the feed wheel 14/separator 16 nip in FIG. 1, and is about to be detected.

When the trailing edge exits the feed wheel 14/separator 16 nip, the accelerator friction force provided by the accelerator pinch force accelerates the document and the accelerator idler 22 until both reach accelerator driver wheel peripheral velocity. Tachometer 24 on accelerator idler 22 measures this velocity increase produced when the trailing edge leaves feed wheel 14.

Because tachometer 24 is a device that converts velocity to an electrical signal, the tachometer signal can be sent to electronics such as control logic 30 to perform the conversion to an output signal provided to control device 40. There are no restrictions on the exact nature of the tachometer output signal. For example, the signal may be a signal proportional to velocity, such as occurs in analog tachometers. The signal may also be a signal representing velocity, such as a pulse sequence of an optical encoder. In either case, the signal is simply a signal that indicates that the tachometer has accelerated.

Figure 2:
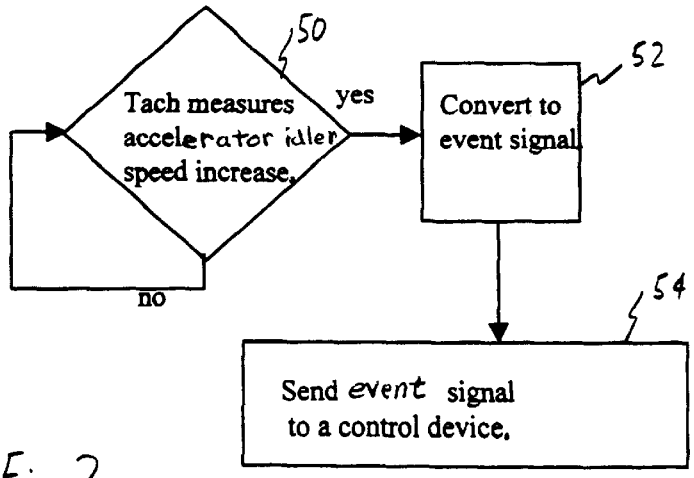
FIG. 2 illustrates a method of detecting a document in a system for feeding and transporting documents according to a preferred embodiment of the present invention.

In FIG. 2, a preferred embodiment of a method of detecting a document in a system for feeding and transporting documents is illustrated. Each document has a leading edge and a trailing edge, with the leading edge being the downstream edge and the trailing edge being the upstream edge. The system includes a feeder stage and a transport stage downstream of the feeder stage and in a preferred embodiment is the system shown in FIG. 1.

The method comprises detecting an acceleration of accelerator idler 22 indicating when the document trailing edge exits feeder 14 and separator 16. In a preferred embodiment after detecting acceleration of accelerator idler 22, an operation is performed. Further, in a preferred embodiment, tachometer 24 at accelerator idler 22 is used to detect acceleration of accelerator idler 22. Again, when tachometer 24 is used to implement methods of the present invention, tachometer 24 may take any suitable form. In the preferred embodiment, block 50 indicates tachometer 24 measuring and detecting a speed increase of accelerator idler 22. The speed increase occurs when the trailing edge of first document 32 exits the nip between feeder 14 and separator 16. After detection, the method comprehends converting the tachometer signal to an event signal and sending the event signal to control device 40 (blocks 52 and 54). Control device 40 performs an operation after the document trailing edge has exited feeder 14 and separator 16.

More specifically, in a preferred embodiment illustrated in FIG. 2, the trailing edge detection algorithm constantly looks for an acceleration at the accelerator idler wheel 22. When detected, a signal is sent to another functional electronic block that converts the velocity signal to an event signal. In a preferred embodiment, the detection of accelerator idler wheel acceleration is accomplished by periodically comparing the tachometer signal from tachometer 22 with a reference tachometer signal from feeder tachometer 42 that represents feeder velocity. When a relative acceleration of the accelerator idler with respect to the feeder occurs, the document trailing edge has exited feeder 14 and separator 16. Block 52 of FIG. 2 converts acceleration to an event signal. The event signal may be either digital or analog. The event signal is sent to one or more control devices that will initiate operations when the trailing edge exits the feeder. Examples of these operations may be, but are not limited to: accelerate the document with the accelerator after the trailing edge has left the feeder, relieve or increase pinch pressure from the separator as needed, stop or slow the feed wheel when the trailing edge has left the feeder to create space between documents, or increase or decrease pinch pressure from the accelerator idler as needed.

It is appreciated by those skilled in the art that FIGS. 1 and 2 illustrate preferred embodiments of a system and method of the present invention and that various alterations may be made to the system and method illustrated. For example, the feeder and separator may take other forms besides the illustrated feed wheel 14 and separator wheel 16. The transporting portion 12 of the system may take other forms besides roller pair 36 and 38, such as belts to convey the documents so long as a suitable technique is utilized to detect an acceleration of the accelerator idler. Nudger 36 may also take a different form than that illustrated. Further, systems of the present invention utilize a tachometer 24 that may take other forms than the illustrated example. Further, a preferred embodiment of a method of the present invention utilizes a tachometer where other techniques may be utilized for detecting an acceleration of the accelerator idler in methods of the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a feeder and a separator for receiving a document therebetween and gripping the document with a first grip;

a transport stage downstream of the feeder stage, the transport stage including an accelerator driver and an accelerator idler for receiving the document therebetween and gripping the document with a second grip that is less than the first grip such that when the document is simultaneously gripped by the feeder and separator and gripped by the accelerator driver and accelerator idler, the document slips at the accelerator driver until the document trailing edge exits the feeder and separator;

a tachometer at the accelerator idler; and control logic configured to a detect an acceleration of the tachometer indicating when the document trailing edge exits the feeder and separator, and to provide an output signal.

2. The system of claim 1 further comprising:

a control device receiving the output signal, and being configured to perform an operation after the document trailing edge has exited the feeder and separator.

3. The system of claim 1 wherein the tachometer includes an encoder and generates a pulse sequence, and wherein the control logic detects the acceleration based on the pulse sequence.

4. The system of claim 1 wherein the tachometer generates an analog velocity signal, and wherein the control logic detects the acceleration based on the analog velocity signal.

5. The system of claim 1 further comprising:

a feeder tachometer at the feeder, wherein the control logic is configured to detect a relative acceleration of the accelerator idler tachometer with respect to the feeder tachometer indicating when the document trailing edge exits the feeder and separator.

6. The system of claim 5 further comprising:

a control device receiving the output signal, and being configured to perform an operation after the document trailing edge has exited the feeder and separator.

7. A method of detecting a document in a system for feeding and transporting documents, the document having a leading edge and a trailing edge, the system including a feeder stage including a feeder and a separator for receiving a document therebetween and gripping the document with a first grip, and a transport stage downstream of the feeder stage, the transport stage including an accelerator driver and an accelerator idler for receiving the document therebetween and gripping the document with a second grip that is less than the first grip such that when the document is simultaneously gripped by the feeder and separator and gripped by the accelerator driver and accelerator idler, the document slips at the accelerator driver until the document trailing edge exits the feeder and separator, the method comprising:

detecting an acceleration of the accelerator idler indicating when the document trailing edge exits the feeder and separator.

8. The method of claim 7 further comprising:

after detecting the acceleration of the accelerator idler, performing an operation after the document trailing edge has exited the feeder and separator.

9. The method of claim 7 further comprising:

providing a tachometer at the accelerator idler.

10. The method of claim 9 wherein the tachometer includes an encoder and generates a pulse sequence.

11. The method of claim 9 wherein the tachometer generates an analog velocity signal.

12. The method of claim 7 further comprising:

detecting a relative acceleration of the accelerator idler with respect to the feeder indicating when a document trailing edge exits the feeder and separator.

13. The method 12 further comprising:

after detecting the acceleration of the accelerator idler, performing an operation after the document trailing edge has exited the feeder and separator.

14. The method of claim 12 further comprising:

providing a tachometer at the accelerator idler; and providing a feeder tachometer at the feeder.

* * * * *